US005988587A

United States Patent [19]

Duchon et al.

[11] Patent Number: 5,988,587

[45] Date of Patent: Nov. 23, 1999

[54] CONTROL DEVICE FOR PROVIDING A VARIABLE CONTROL SIGNAL TO A FLUID-SUPPLYING MACHINE

[75] Inventors: Doug Duchon, Chanhassen; Vince Copa, St. Paul, both of Minn.

[73] Assignee: Invasatec, Inc., Eden Prairie, Minn.

[21] Appl. No.: 08/948,856

[22] Filed: Oct. 10, 1997

[51] Int. Cl.[6] ..... G05G 1/00

[52] U.S. Cl. ..... 251/129.04; 251/291; 74/491

[58] Field of Search ..... 251/129.04, 291, 251/293, 294; 74/491, 500.5, 501.6

[56] References Cited

U.S. PATENT DOCUMENTS 4,829,844 5/1989 Boomgaarden et al. ..... 74/470

5,589,828 12/1996 Armstrong ..... 74/471 X 5,831,596 11/1998 Marshall et al. ..... 74/471 X

*Primary Examiner*—Kevin Lee

*Attorney, Agent, or Firm*—Oppenheimer Wolff & Donnelly, LLP

[57] ABSTRACT

A control device for controlling a fluid supplying machine. The control device includes a first handle and a second handle connected by a resilient attachment member. The resilient attachment member is configured to allow the first handle to move with respect to the second handle in response to an input from an operator. The control device further includes a sensor attached to the first handle for producing a variable control signal indicative of a distance between the first handle and the second handle.

22 Claims, 5 Drawing Sheets

CONTROL DEVICE FOR PROVIDING A VARIABLE CONTROL SIGNAL TO A FLUID-SUPPLYING MACHINE

BACKGROUND OF THE INVENTION

The present invention relates to a control device for a machine that regulates fluid flow. More particularly, the control device produces a variable control signal between a preset maximum value and a minimum value, proportional to the distance between movable members to control a fluid-supplying machine.

The biomedical, chemical and food processing industries have numerous processes that require real-time fluid-flow control. These processes typically use automatic valves and variable pressure pumps controlled by a signal from a computer or human operator. In most applications using real-time control, the operator who controls the fluid-supplying machine needs accurate rate control and the ability to quickly respond to unexpected events. Satisfaction of these needs requires a control device that is located near the flow rate instrumentation and that produces either an analog control signal or a multi-bit digital control signal. The ideal control device for real-time control applications also provides an intuitive user interface that can reduce the possibility of error in an emergency situation.

The design of a mobile control device must also account for environmental concerns in addition to providing an appropriate control signal. This is a significant problem in the biomedical, chemical, and food processing industries because contaminants can ruin many of the associated products. Bacterial contamination is a particular problem for biomedical and processed food companies because their products usually require sterile conditions. These industries require constant sterilization of the control device without damaging or degrading the functional performances of the electrical and mechanical components. Furthermore, any control device used in these industries must be designed without openings that can trap contaminants between moving parts.

In addition to the contamination problem, many operations in the biomedical, chemical, and food processing industries involve the use of corrosive fluids. Control devices used in these applications must resist corrosion and must allow an operator to effectively clean all exposed surfaces. Because corrosive fluids can quickly damage electronics, a well-designed control device should also protect its electrical components.

One common control device design uses push-buttons to produce a binary control signal. However, this method will not work satisfactorily in many applications because the fluid can only flow at two predetermined rates. The addition of variable control would significantly improve this design because the fluid-supplying machine could then operate anywhere between a maximum and minimum flow rate. Adding this feature would allow a user to optimize operation of the fluid-supplying machine.

A common improvement to the push-button controller increases the number of operating states with a microprocessor. In this design, one button typically increases the fluid flow from one operating point to another. A second button decreases the flow rate, and a third button resets the machinery. An operator must press a button several times or hold down a button for several seconds to make a large change in fluid flow rate. Different implementations reduce the time necessary to move between flow rates by increasing the increment caused by each press of a button. However, this decision trades off speed of response against control accuracy. The push-button design also causes accidents because an operator can mistakenly press the wrong button in an emergency.

The controllers currently used in industry also have other flaws. For example, many of the controllers fail to seal their electronic components from the environment. This omission exposes the sensors to corrosion, increases the risk of shorting in the electrical system, and decreases the number of cleaning methods a customer can use on the control device.

The above-described control devices have all been created to control a fluid-supplying machine. However, none of these devices combines the advantages of a variable control signal with the ability to be cleaned and sterilized. These shortcomings greatly detract from the utility of existing control devices in the biomedical, chemical, and food processing industries. Therefore, a substantial need exists for a sealed control device able to provide a variable control signal to a fluid-supplying machine.

SUMMARY OF THE INVENTION

The present invention provides a control device for generating a variable control signal between a preset maximum and minimum value to a fluid-supplying machine. The control device includes a first handle, a second handle, a resilient attachment member and a sensor. The first handle and the second handle are connected by the resilient attachment member such that an operator can choose a distance between the first handle and the second handle. The first sensor is operatively connected to the first handle and is capable of producing a control signal as a function of a distance between the first handle and the second handle. In one embodiment, an enclosure seals the sensor from the environment.

During use, an operator applies an input to the control device by exerting a force on the first handle and the second handle. This input causes the first handle to move toward the second handle. The sensor senses a change in distance between the first handle and the second handle, and produces a signal representative of this change in positioning. The resulting control signal controls the amount of fluid being supplied by the fluid-supplying machine. In the preferred embodiment, as the handles are positioned closer to one another, the resulting control signal calls for an increase in fluid flow. To decrease fluid supply, the operator decreases the compressive force applied to the first handle and the second handle. The resilient attachment member, in turn, biases the first handle away from the second handle. The sensor senses the resulting increased distance between the first handle and the second handle, and generates a representative control signal. This control signal, in turn, causes the fluid-supplying machine to reduce the flow of fluid. Thus, the control signal generated by the sensor is variable in that it changes with any change in distance between the first handle and the second handle. In the preferred embodiment, the sealed enclosure protects the sensor from contact with any fluids, allowing for safe sterilization/cleaning of the control device.

DETAILED DESCRIPTION OF THE PREFERRED EMBODIMENTS

Figure 1:
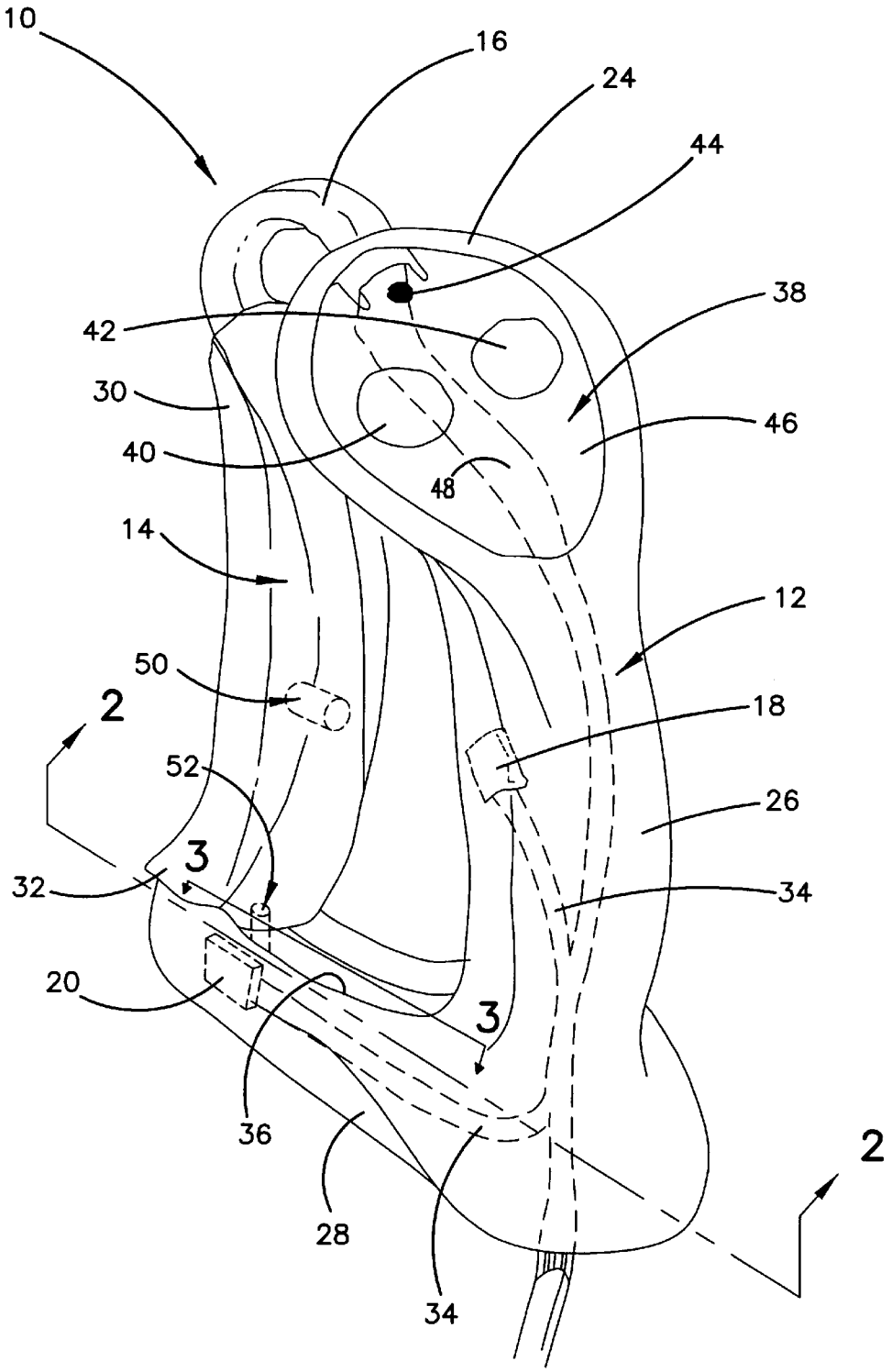
FIG. 1 is a perspective view of a control device in accordance with the present invention.

One embodiment of a control device 10 is shown in FIG. 1. The control device 10 includes a first handle 12, a second handle 14, a resilient attachment member 16, a first sensor 18, and a second sensor 20. The first handle 12 includes a head 24, an intermediate portion 26 and a base portion 28. The head 24 is attached to the resilient attachment member 16. The second handle 14 includes an attached end 30, which is attached to the resilient attachment member 16, and a free end 32. The first sensor 18 is disposed within the intermediate portion 26 of the first handle 12. Similarly, the second sensor 20 is disposed within the base portion 28 of the first handle 12. The first sensor 18 and the second sensor 20 are connected by wiring 34 to a fluid-supplying machine (not shown).

The intermediate portion 26 of the first handle 12 is preferably designed to fit within an operator's palm (not shown). In one embodiment, the base portion 28 of the first handle 12 extends away from the intermediate portion 26 at approximately a 90° angle. Further, the base portion 28 includes a slot 36. The slot 36 extends along an approximately length of the base portion 28. The relationship of the slot 36 to remaining components of the control device 10 is described in greater detail below.

The first handle 12 also includes, in one embodiment, a secondary input 38 positioned on the head 24. The secondary input 38 includes a first button 40, a second button 42, a signaling device 44, and a membrane 46. The first button 40, the second button 42, and the signaling device 44 are connected by wiring 48 to the fluid-supplying machine (not shown). As described in greater detail below, the first button 40 and the second button 42 provide an operator with additional control over the fluid-supplying machine (not shown). For example, the first button 40 can be used to initiate the fluid-supplying machine, while the second button 42 can be used to change the type of fluid delivered. The signaling device 44 preferably indicates activation of the fluid-supplying machine. Finally, the membrane 46 covers the first button 40, the second button 42, and the signaling device 44 such that external fluids will not contact the first button 40, the second button 42, the signaling device 44, or the wiring 48.

The second handle 14 is preferably designed to be grasped by the fingers of an operator (not shown). The second handle 14 includes a first magnet 50 and a second magnet 52. The first magnet 50 is positioned within an intermediate portion of the second handle 14, at the same approximate level as the first sensor 18. The second magnet 52 extends outwardly from the free end 32 of the second handle 14. The second magnet 52 is preferably maintained within a cylindrical enclosure such as a pin 75 and is sized to move within the slot 36 of the first handle 12.

The resilient attachment member 16 is preferably made from a strong yet flexible material, and assumes a curved shape as shown in FIG. 1. With the configuration shown in FIG. 1, the resilient attachment member 16 biases the second handle 14 away from the first handle 12. More particularly, the resilient attachment member 16 forces the free end 32 of the second handle 14 away from the intermediate portion 26 of the first handle 12.

The first sensor 18 and the second sensor 20 are preferably Hall effect sensors. The first sensor 18 is associated with the first magnet 50. Hall effect sensors are well known in the art. Basically, the first magnet 50 produces a magnetic field perpendicular to the first sensor 18. The first sensor 18 generates an output voltage (or Hall voltage) which is proportional to the strength of the magnetic field generated by the first magnet 50. As the first magnet 50 is positioned closer to the first sensor 18, the force of the magnetic field sensed by the first sensor 18 increases, thus increasing the voltage produced by the first sensor 18. Thus, the first sensor 18 can "sense" or respond to a change in the distance between the first handle 12 and the second handle 14. The signal produced by the first sensor 18 is a variable control signal in that the signal varies as a function of the distance between the first sensor 18 the first magnet 50, and thus between the first handle 12 and the second handle 14.

The second sensor 20, in conjunction with the second magnet 52, is similar to the first sensor 18. In the preferred embodiment, however, the second sensor 20 is a simple digital type sensor, generating an on/off signal. Greater details on the second sensor 20 are provided below.

The wiring 34 communicates the control signal generated by the first sensor 18 (and the second sensor 20) to the fluid-supplying machine (not shown). In the preferred embodiment, the wiring 34 is directly connected to the fluid-supplying machine. However, other forms of communication devices are acceptable. For example, the wiring 34 can be replaced with an infra red or r.f. transmitter which transmits the control signal to an appropriate receiver associated with the fluid-supplying machine.

In addition to providing a magnetic field for the second sensor 20, the second magnet 52 serves as a guide for the second handle 14. As previously described, the second magnet 52 extends outwardly from the free end 32 of the second handle 14. As shown in FIG. 1, the second magnet 52 rides within the slot 36 in the base portion 28. Thus, when the second handle 14 is moved with respect to the first handle 12, the second magnet 52 interacts with the slot 36 to insure that the movement occurs in a relatively planar direction. Further, the pin 75 containing the second magnet 52 provides a stop to the biasing action of the resilient attachment member 16. In this regard, the second magnet 52 abuts a leading end of the slot 36. In this abutting position, the second magnet 52 prevents or stops the flexible attachment member 16 from biasing the second handle 14 further away from the first handle 12. Further details on the design of the slot 36 are provided below.

Figure 2:
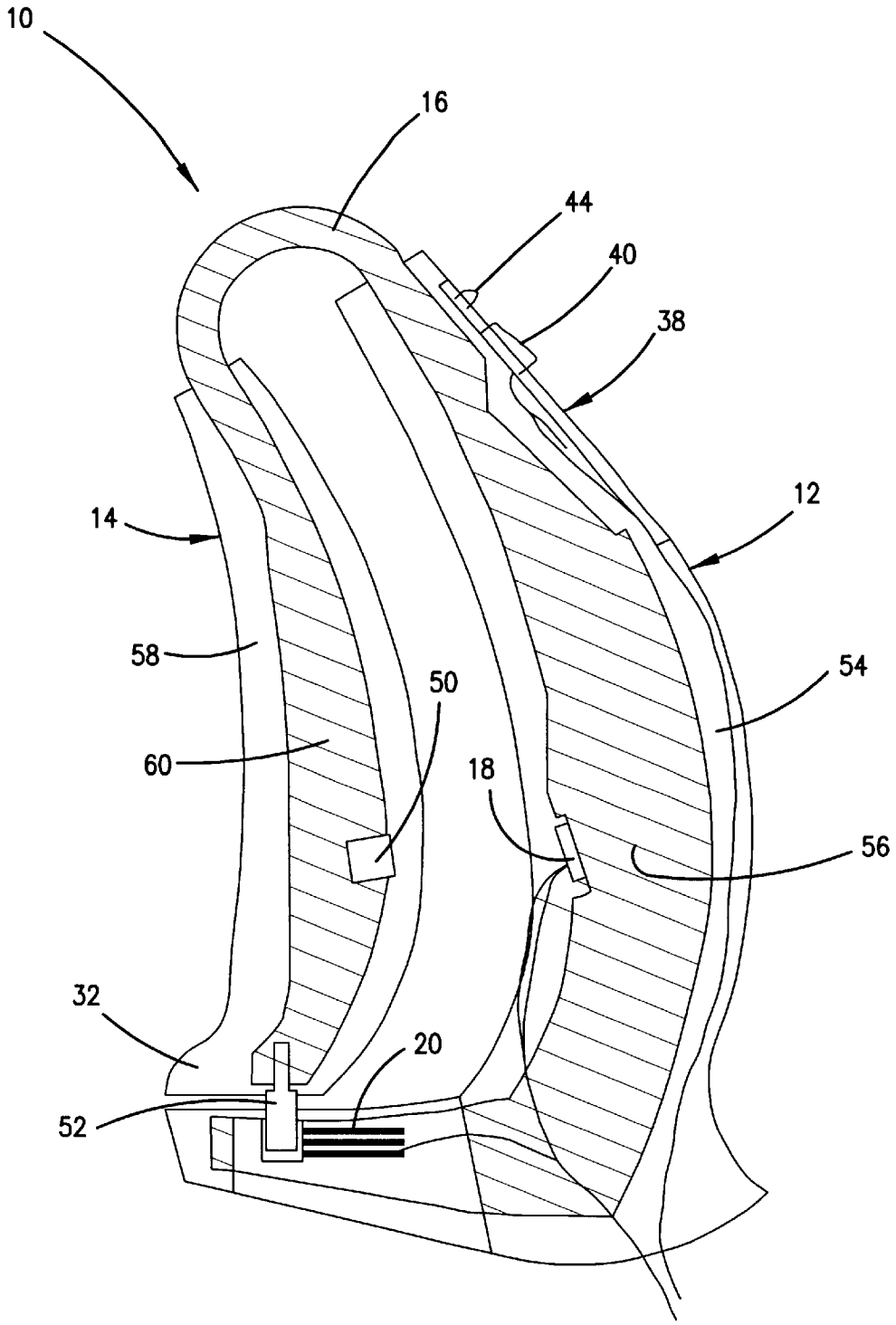
FIG. 2 is a cross-sectional, somewhat schematic, view of one embodiment of the control device along the line 2—2 of FIG. 1.

Further details on construction of the control device 10 are depicted in FIG. 2. As shown in FIG. 2, a first enclosure 54 encapsulates the first sensor 18 and the second sensor 20. In the preferred embodiment, the first enclosure 54 is cast from a thermoset urethane polymer which can withstand thermal, chemical and ultraviolet sterilization methods. Alternatively, any moldable polymer which is capable of withstanding repeated use and adverse environments is acceptable. The first enclosure 54 is sealed and set around an internal portion 56 of the first handle 12. With this construction, the first enclosure 54 encapsulates and seals the first sensor 18 against the internal portion 56 of the first handle 12. Similarly, the first enclosure 54 encapsulates and seals the second sensor 20 against the internal portion 56 of the first handle 12. In an alternative embodiment, at least a portion of the first sensor 18 is cast or potted into the internal portion 56 of the first handle 12. The first enclosure 54 is then over molded using a thermoplastic injection molded material. Regardless of how it is formed, the first enclosure 54 is preferably formed to fit within an operator's hand.

In one embodiment, the control device 10 includes a second enclosure 58 which is sealed to and formed about an internal portion 60 of the second handle 14. Similar to the first enclosure 54, the second enclosure 58 is preferably cast from a thermoset urethane polymer which can withstand thermal, chemical, and ultraviolet sterilization methods. The second enclosure 58 seals the first magnet 50 against the internal portion 60 of the second handle 14. In one embodiment, the second magnet 52 is sealed within a hollow pin (not shown) which in turn is attached to the second handle 14 as shown in FIG. 2. With this configuration, the hollow pin containing the second magnet 52 extends downwardly from the free end 32 of the internal portion 60 of the second handle 14. The second enclosure 58 is formed around the hollow pin/second magnet 52.

Further, the second enclosure 58 is formed to fit within an operator's fingers. It should be recognized, however, that the second enclosure 58 is not a necessary element. The second handle 14 shown in FIG. 2 does not include any electrical components, unlike the first handle 12. Thus, there is no concern for protecting electrical components from the environment. Basically then, the second enclosure 58 simply provides a uniform appearance to the control device 10, while form fitting the second handle 14 to the operator's fingers. Alternatively then, the internal portion 60 can be manufactured to assume this preferred shape and the second enclosure 58 omitted.

While the first enclosure 54 is shown as encompassing the first handle 12, the first enclosure 54 need only sealably enclose the first sensor 18 and the second sensor 20 from the environment. Alternatively then, the first sensor 18 and the second sensor 20 can be positioned within the internal portion 56, thus eliminating the need for the first enclosure 54.

As shown in FIG. 2, the internal portion 56 of the first handle 12, the resilient attachment member 16 and the internal portion 60 of the second handle 14 are constructed as a uniform body and form a backbone. In the preferred embodiment, the backbone is made from a resinous material such as acetal resin. The resin is hardened through the molding process to provide the requisite resiliency for the resilient attachment member 16. Further, the resin is designed to withstand thermal, chemical, and ultraviolet sterilization methods while yielding excellent fatigue and environment properties.

During use, the control device 10 is initially in a null position shown in FIGS. 1 and 2. In the null position, the resilient attachment member 16 biases the second handle 14 away from the first handle 12 such that the second magnet 52 abuts the leading end of the slot 36. In the null position, the second handle 14 is at a maximum distance from the first handle 12. Thus, the first magnet 50 is at a maximum distance from the first sensor 18. In the null position, the first sensor 18 produces a control signal representative of "no flow." In other words, the control signal produced by the first sensor 18 is interpreted by the fluid-supplying machine (not shown) as calling for no fluid.

To initiate the fluid flow from the fluid-supplying machine, an operator (not shown) grasps the control device 10 such that the first handle 12 rests in the operator's palm while the second handle 14 is held by the operator's fingers. The operator supplies an input to the control device 10 by forcing the second handle 14 toward the first handle 12. In the preferred embodiment, the control device includes a lock which the operator must disengage prior to use. Further details on the lock are provided below. As the second handle 14 moves toward the first handle 12, the signal produced by the first sensor 18 changes in response to the position of the first magnet 50. As the second handle 14, and thus the first magnet 50, is forced toward the first sensor 18, the first sensor 18 varies the control signal to require increased fluid flow from the fluid-supplying machine (not shown). Thus, the first sensor 18 produces a variable control signal as a function of the distance between the first handle 12 and the second handle 14. As the second handle 14 is drawn closer to the first handle 12, the control signal generated by the first sensor 18 varies, producing a signal representative of increased fluid flow.

To maintain a steady flow of fluid from the fluid-supplying machine (not shown), the operator simply maintains the position of the second handle 14 with respect to the first handle 12. In this control position, the first sensor 18 generates a consistent control signal which is interpreted by the fluid-supplying machine as calling for a same fluid flow.

To decrease fluid flow from the fluid-supplying machine (not shown), the operator (not shown) simply increases the distance between the first handle 12 and the second handle 14 by reducing the force applied to the second handle 14. The resilient attachment member 16 biases the second handle 14 away from the first handle 12. As the second handle 14, and thus the first magnet 50, moves away from the first handle 12, the first sensor 18 produces a control signal representative of a reduction in fluid flow to the fluid-supplying machine. Once again, the first sensor 18 generates a variable control signal as a function of the distance between the first handle 12 and the second handle 14. To stop fluid flow altogether from the fluid-supplying machine, the second handle 14 is allowed to be biased by the resilient attachment member 16 to the null position shown in FIGS. 1 and 2. In this position, the first sensor 18 produces a signal which the fluid-supplying machine recognizes as calling for no fluid flow.

In the preferred embodiment, the control signal generated by the first sensor 18 varies proportionately between a pre-set maximum and minimum value as the second handle 14, and thus the first magnet 50, is moved toward or away from the first handle 12. For example, the first sensor 18 may produce a control signal representative of a fluid flow of 5 mls/second when the second handle 14 is moved one-fourth of the maximum distance toward the first handle 12; 10 mls/second at one-half maximum distance; and 15 mls/second at three-fourths maximum distance. However, the control signal generated by the first sensor 18 can be utilized by the fluid-supplying machine to call for incrementally different fluid flows. For example, when the second handle 14 is moved from the null position to one-fourth of the maximum allowable movement, a signal could be produced representative of 1 ml/second; 10 mls/second at one-half maximum distance; and 50 mls/second at three-fourths maximum distance. Other control signal interpretations are equally acceptable, so long as the control signal generated by the first sensor 18 varies as a function of the distance between the first handle 12 and the second handle 14.

The second sensor 20 is preferably designed to generate a digital, on/off signal. The digital signal produced by the second sensor 20 is used to indicate that the second handle 14 is in the null position. When the second handle 14, and thus the second sensor 20, is in the null position shown in FIG. 2, the second sensor 20 supplies a digital signal representative of the control device 10 being in an "off" position. Once the second magnet 52 is moved away from the second sensor 20, the second sensor 20 produces a digital signal indicative of the control device being activated. Thus, the second sensor 20 is preferably used to sense whether the second handle 14 is in the null or undeflected state. Further, once the second handle 14 is maneuvered away from the second sensor 20, the second sensor 20 signals activation of the fluid-supplying machine (not shown). The second sensor 20 is also used to calibrate the first sensor 18, in that the "off" state and "on" state of the second sensor 20 can be compared with the signal generated by the first sensor 18. It should be understood that the second sensor 20 is not a required element in that the necessary variable control signal is provided solely by the first sensor 18. If the second sensor 20 is eliminated, the second magnet 52 can be replaced with a dowel or similar body sized to fit within the slot 36.

The secondary input 38 is used to provide additional control over the fluid-supplying machine (not shown). The first button (40 in FIG. 1) and the second button (42 in FIG. 1) are preferably push buttons which effectuate an on-off control signal. The first button 40 and the second button 42 can represent a variety of different control functions. For example, the first button 40 can be used to reset the fluid flow process. The second button 42 can be used to call for an alternative fluid to be delivered. Where, for example, the fluid-supplying machine contains both a therapeutic material and a saline solution, the second button 42 can be used to switch from one fluid to the other. Finally, the signaling device 44 signals the operator (not shown) as to the operational status of the fluid-supplying machine. In the preferred embodiment, the signaling device 44 is a light-emitting diode. Notably, while the preferred embodiment includes the secondary input 38, it is not a required element. The control device 10 will control fluid flow equally as well without the secondary input 38, which simply provides an auxiliary form of control.

Figure 3:
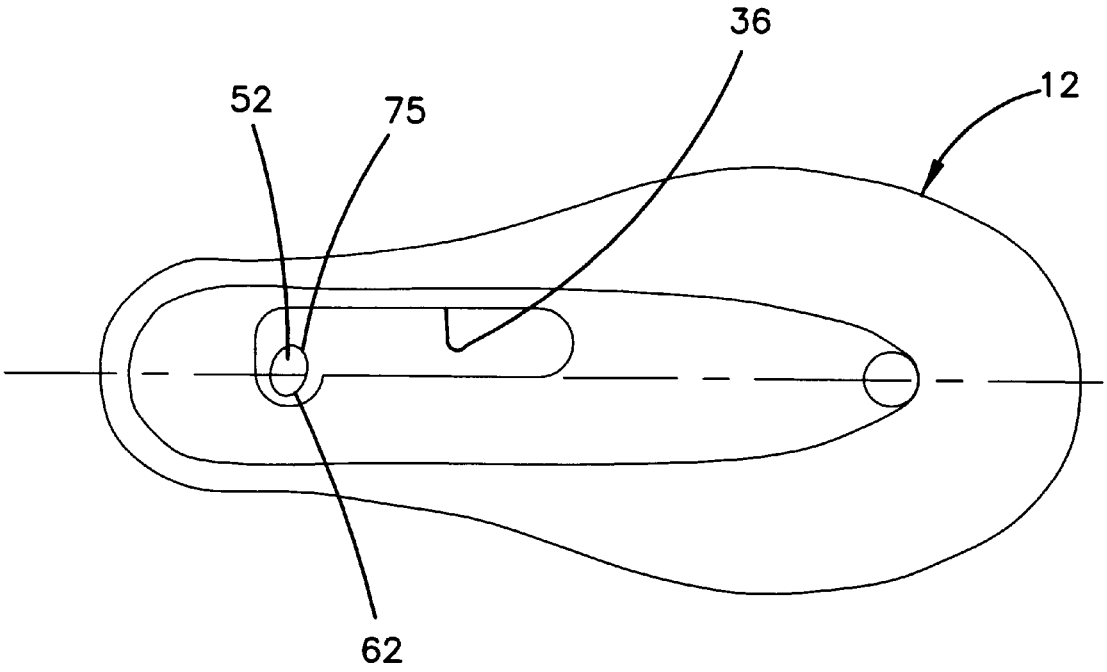
FIG. 3 is a schematic, sectional view of one embodiment of the control device along the line 3—3 of FIG. 1.

As previously described, prior to use, the control device 10 is maintained in a null position. To avoid accidental activation of the control device 10, the slot 36 is preferably provided with a shoulder 62 as shown in FIG. 3. In the null position, the second magnet 52, which as previously described is preferably sealed within a hollow pin, rests within the shoulder 62. When an operator (not shown) attempts to pick up the control device 10 (shown in FIG. 1), the force required to do so will not accidentally or unexpectedly move the second handle 14 (shown in FIG. 1) towards the first handle 12 (shown in FIG. 1) which would otherwise cause activation of the fluid-supplying machine (not shown). To initiate fluid flow, an operator must consciously maneuver the second handle 14 (shown in FIG. 1) such that the second magnet 52 moves out from the shoulder 62 and into the slot 36. Once the second magnet 52 is maneuvered from the shoulder 62, the second sensor 20 signals activation of the fluid-supplying machine. Subsequently, the second handle 14 is moved by the operator to control flow rate from the fluid-supplying machine via a signal from the first sensor (18 in FIG. 1).

Figure 4:
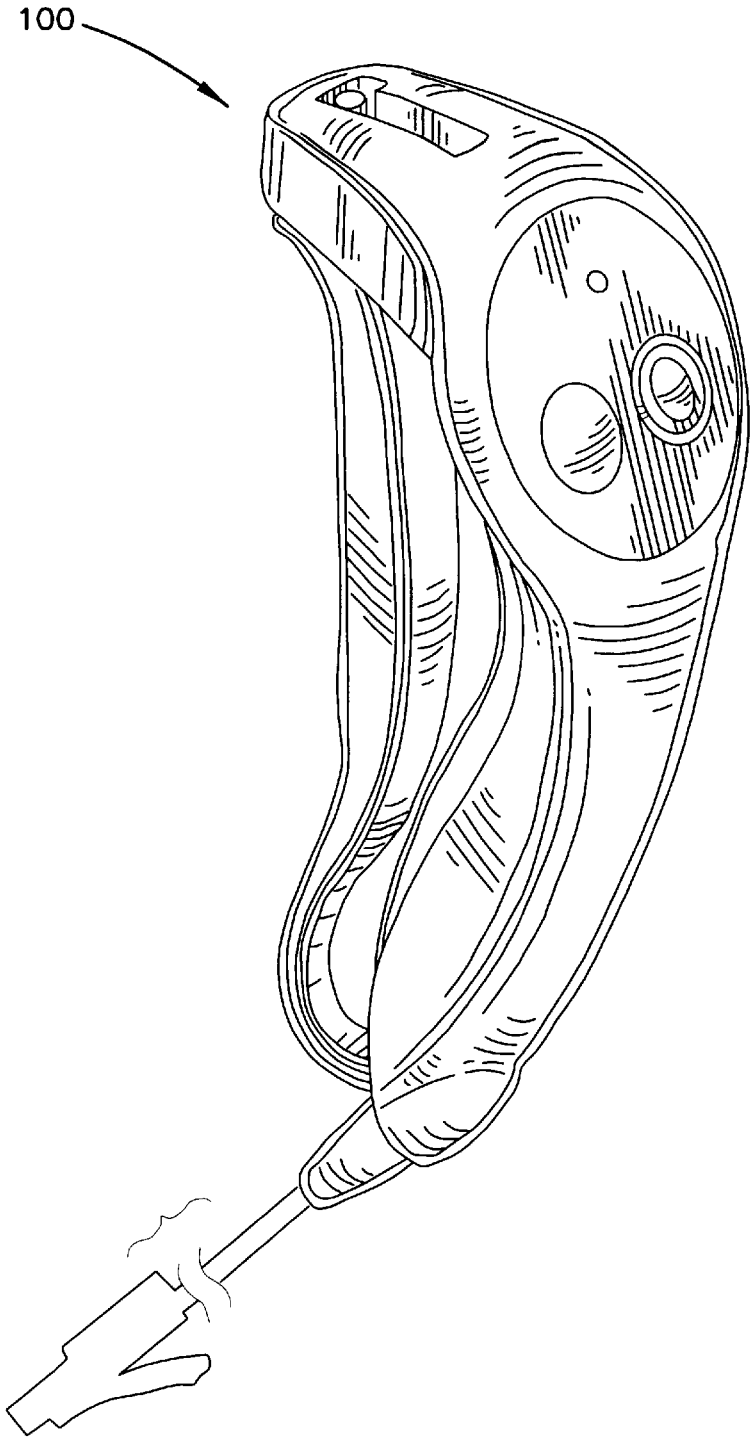
FIG. 4 is a perspective view of a second embodiment of a control device.
Figure 5:
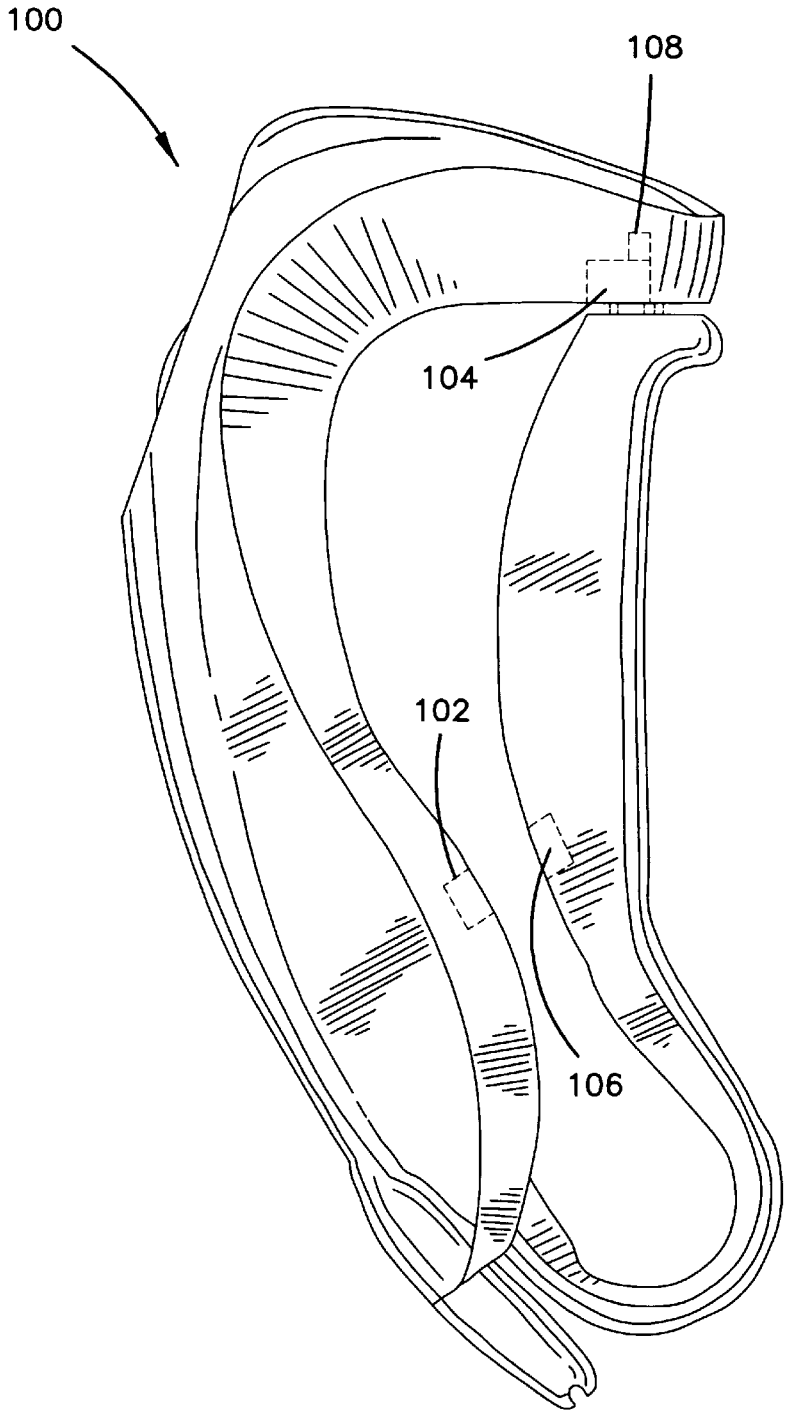
FIG. 5 is a side elevational view of the control device of FIG. 4.

FIG. 4 illustrates a second embodiment of a hand controller at 100. The function and principles of operation are analogous to the hand controller described in FIGS. 1–3. FIG. 5 schematically shows the hand controller 100 including sensors 102 and 104, analogous to sensors 18 and 20, and magnets 106 and 108, analogous to magnets 50 and 52.

The control device of the present invention provides a unique apparatus for controlling a fluid-supplying machine. The control device includes a sensor capable of producing a variable control signal representative of a distance between two control handles. This distance is selectively controlled by an operator. Thus, an operator can vary fluid flow from a fluid-supplying machine over a range of possible flow rates by simply varying the position of the two handles with respect to one another. This variable control feature is unique over known prior art control devices. Further, in the preferred embodiment, an enclosure seals the sensor from the environment. Thus, the control device can be used in a variety of applications where the work environment involves corrosive fluids. Even further, because of the enclosure, the control device can be sterilized between uses without damaging the sensor. This feature is extremely important with medical applications where repeated sterilization is required.

Although the present invention has been described with reference to preferred embodiment, workers skilled in the art will recognize that changes may be made in form and detail without departing from the spirit and scope of the invention. For example, the resilient attachment member has been preferably described as being a curved, resinous body. However, the resilient attachment member can assume a variety of forms and materials. For example, the resilient attachment member can be a metallic spring. Other approaches are equally acceptable so long as the resilient attachment member biases the first handle to a known position with respect to the second handle.

Similarly, the preferred design may be altered to provide for an adjustable spring rate of the resilient attachment member. This is accomplished by configuring the second enclosure (58 in FIG. 2) to be selectively positioned along the second handle (14 in FIG. 2) by the user. Thus, the user could change the effective beam length, and thus the spring rate, to whatever level is desired.

The sensors have been preferably described as being Hall effect devices. However, other sensors such as strain gauges, RVDTs and optical encoders having the ability to produce a signal related to the distance between the first handle and the second handle are also acceptable. Similarly, a pressure sensor can be used to produce a variable control signal that is proportional to the compressive force applied by an operator. Additionally, the control device 10 can include a dynamic actuator whereby feedback is supplied to the flexible attachment member to increase or decrease the opposition force generated by the flexible attachment member in response to an increase or decrease in pressure of the fluid being delivered.

Finally, the first handle and the second handle have been described as preferably being elongated members of approximately equal length, sized to fit within an operator's hand. Other designs are acceptable. For example, the control device can assume the shape of a hand gun. With this embodiment, the first handle would be a stock and the second would be a trigger. Similar approaches can be utilized so long as an operator is provided with two "handles" which are movable with respect to one another so that the operator can change the position of one handle with respect to the other handle. This change in position is sensed by a sensor which in turn generates a variable control signal.

We claim:

1. A control device for providing a variable control signal to a fluid-supplying machine, the device comprising:

a first handle;

a second handle a resilient attachment member connecting the first handle to the second handle such that an operator can select a distance between the first handle and second handle; and a first sensor operatively associated with the second handle for generating a control signal as a function of said distance between the first handle and second handle.

2. The device of claim 1, further comprising:

a communication device connected to the first sensor for communicating the control signal from the first sensor to the fluid-supplying machine.

3. The device of claim 1, further comprising:

an enclosure sealing the first sensor to one of the first handle or second handle such that external fluids cannot contact the first sensor.

4. The device of claim 3, wherein the enclosure is a polymer material.

5. The device of claim 3, wherein the first handle includes a head portion, an intermediate portion, and a base portion, and further wherein the enclosure encompasses the intermediate portion of the first handle and is configured to be hand held.

6. The device of claim 1, wherein the first sensor is a Hall effect sensor, the device further comprising:

a magnetic body attached to the second handle for producing a magnetic field sensed by the first sensor.

7. The device of claim 6, wherein the first handle includes a head portion connected to the resilient attachment member, an intermediate portion, and a base, wherein the second handle includes a connecting end connected to the resilient attachment member and a free end, and further wherein the first sensor and the magnetic body are positioned such that as the free end of the second handle is moved with respect to the intermediate portion of the second handle, the magnetic body moves with respect to the first sensor.

8. The device of claim 1, further comprising:

a signaling device disposed on the first handle for indicating status information about a fluid-supplying machine.

9. The device of claim 1, wherein the resilient attachment member is formed from a resinous material.

10. The device of claim 1, wherein the resilient attachment member is a curved body.

11. The device of claim 1, wherein the resilient attachment member is configured to maintain the first handle and the second handle in a null position when not receiving an input from an operator and further such that an operator can move the first handle and the second handle to a command position, and wherein the first sensor produces a signal related to a distance between the null position and the command position.

12. The device of claim 11, where the resilient attachment member is configured to bias the first handle and the second handle from the command position to the null position.

13. The device of claim 1 wherein the first handle includes a head and a base, and wherein the second handle includes a connecting end and a free end, and further wherein the base includes a slot for receiving the free end of the second handle.

14. The device of claim 13, wherein the slot in the first handle includes a shoulder for selectively maintaining the free end of the second handle.

15. The device of claim 1, further comprising:

a secondary input device associated with the first handle for receiving an operational input from an operator related to operation of the fluid-supplying machine.

16. The device of claim 15, wherein the secondary input device is a keypad covered by a membrane.

17. A control device for controlling a fluid-supplying machine, the device comprising:

a first control surface;

a second control surface;

biasing means connecting a portion of the first control surface to a portion of the second control surface, wherein the biasing means is configured to bias the first control surface to a known position with respect to the second control surface; and sensing means operatively associated with the second control surface for producing a variable control signal indicative of a position of the first control surface with respect to the second control surface.

18. The device of claim 17, further comprising:

communication means connected to the sensing means for communicating the variable control signal from the sensing means to the fluid-supplying machine.

19. The device of claim 17, further comprising:

an enclosure sealing the sensing means such that external fluids cannot contact the sensing means.

20. The device of claim 17, wherein the sensing means includes a Hall effect sensor attached to the first control surface and a magnetic means associated with the second control surface.

21. The device of claim 17, wherein the first control surface and the second control surface are configured to receive an input from an operator, and further wherein the sensing means is configured to alter the variable control signal in response to the input.

22. The device of claim 21, wherein the biasing means is configured to oppose the input placed on the first control surface and the second control surface.

* * * * *